US006647890B2

(12) United States Patent
Findlay

(10) Patent No.: US 6,647,890 B2
(45) **Date of Patent: *Nov. 18, 2003**

(54) SELF-CONTAINED ROUND HAVING RING AIRFOIL PROJECTILE AND LAUNCHER THEREFOR

(75) Inventor: David Findlay, Guilford, CT (US)

(73) Assignee: Guilford Engineering Associates, Inc., Guilford, CT (US)

( * ) Notice: Subject to any disclaimer, the term of this patent is extended or adjusted under 35 U.S.C. 154(b) by 0 days.

(21) Appl. No.: 09/996,045

(22) Filed: Nov. 28, 2001

(65) Prior Publication Data

US 2003/0097952 A1 May 29, 2003

(51) Int. Cl.[7] ..... F42B 8/00; F42B 10/00; F42B 12/00; F42B 30/00

(52) U.S. Cl. ..... 102/503; 102/430; 102/439; 102/520; 102/521; 102/522; 102/523

(58) Field of Search ..... 102/430, 439, 102/503, 520–523

(56) References Cited

U.S. PATENT DOCUMENTS

| | | | | | |
|---|---|---|---|---|---|
| 1,741,901 | A | * | 12/1929 | Alden | 102/439 |
| RE18,252 | E | * | 11/1931 | Alden | 102/439 |
| 3,120,186 | A | * | 2/1964 | Harvey | 102/439 |
| 3,877,383 | A | | 4/1975 | Flatau | 102/93 |
| 3,898,932 | A | | 8/1975 | Flatau et al. | 102/66 |
| 3,980,023 | A | | 9/1976 | Misevich | 102/92.6 |
| 3,982,489 | A | | 9/1976 | Flatau et al. | 102/92.4 |
| 4,154,012 | A | | 5/1979 | Miller | 42/1 F |
| 4,190,476 | A | | 2/1980 | Flatau et al. | 156/218 |
| 5,487,232 | A | | 1/1996 | Osborne et al. | 42/51 |
| 6,505,561 | B1 | * | 1/2003 | Dietrich | 102/489 |

FOREIGN PATENT DOCUMENTS

| | | | | |
|---|---|---|---|---|
| WO | 99/27319 | * | 6/1999 | 102/520 |

* cited by examiner

*Primary Examiner*—Michael J. Carone
*Assistant Examiner*—Jack Keith
(74) *Attorney, Agent, or Firm*—McCormick, Paulding & Huber LLP

(57) ABSTRACT

A self-contained round of ammunition has a cartridge casing including a tubular body defining a cylindrical rifled bore and a base threadably attached to the casing body and forming a closure for a breech end of the rifled bore. A sabot which carries a ring airfoil projectile is constrained for limited axial movement within and relative to the bore from a loaded position adjacent the base to a fired position wherein an annular arresting lip integrally formed at the muzzle end of the cartridge body engages an annular abutment surface on the sabot. The lip defines a cylindrical muzzle opening having a diameter smaller than the diameter of the bore and larger than the major diameter of the projectile which may pass freely there through. The sabot in its loaded position cooperates with the base to form a pressure chamber therebetween for receiving gasses of explosion generated by a powder charge contained within the base and in communication with a primer mounted in the base. A bore engaging ring on the sabot has lands and grooves complementing associated portions of lands and grooves defining the rifling within the bore. When the round is fired the moving sabot is abruptly halted within the bore by the arresting lip at the muzzle end causing the spinning ring airfoil projectile to separate from the sabot and leave the cartridge along a flight path. A launcher for firing the self contained round includes a detent member which cooperates with a detent notch in the cartridge base to restrain the cartridge against angular movement about its axis and relative to the launcher when it is fired.

14 Claims, 6 Drawing Sheets

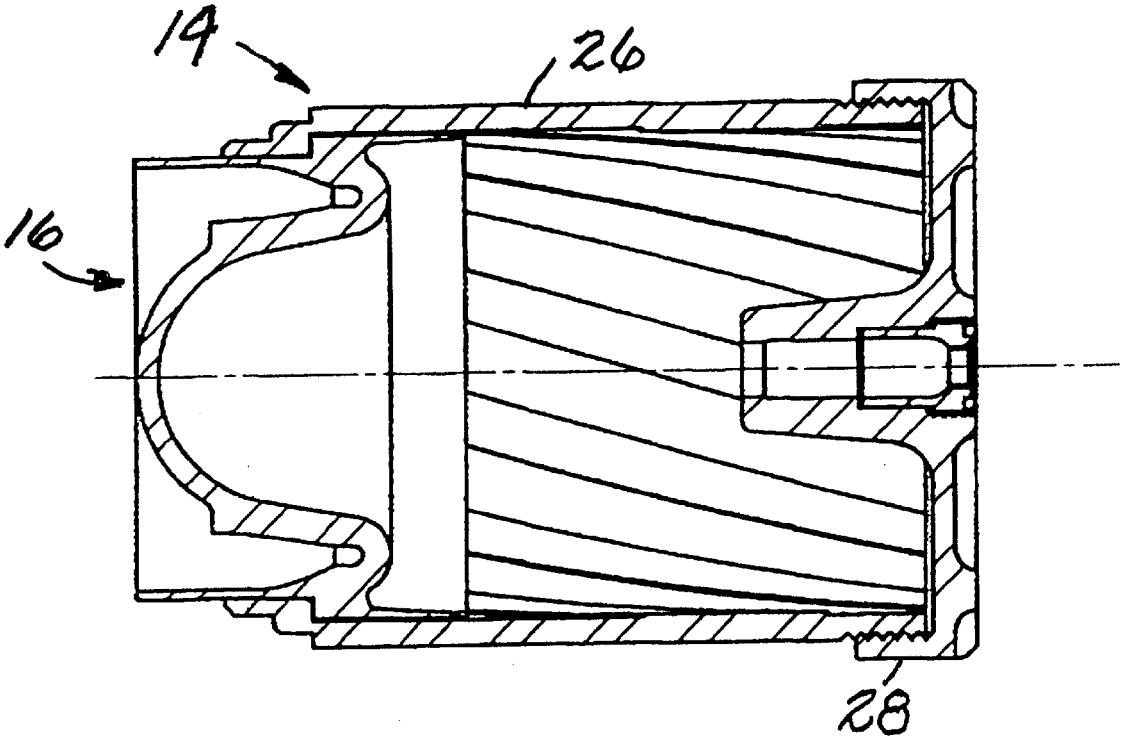
FIG 5
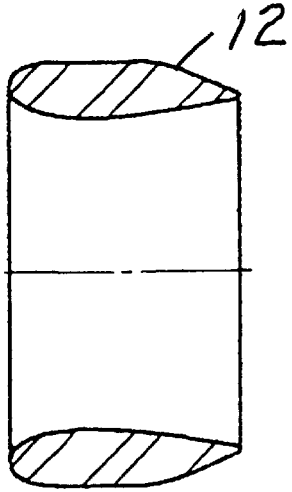

SELF-CONTAINED ROUND HAVING RING AIRFOIL PROJECTILE AND LAUNCHER THEREFOR

FIELD OF INVENTION

This invention relates in general to ammunition and deals more particularly with a round of ammunition of the type which includes a ring airfoil projectile carried by a sabot and a launcher for such a round.

BACKGROUND OF THE INVENTION

The recent devastating terrorist attack on the World Trade Center, New York, N.Y., has given rise to proposals that pilots and air crews of commercial airliners be armed. However the potential risk of catastrophe resulting from the discharge of a conventional firearm in a commercial aircraft at high altitude causing cabin window breakage or fuselage rupture and producing sudden cabin depressurization gives cause for concern.

Ring airfoil projectiles are well known in the ballistic art. Such a projectile generally comprises a closed circular ring defining a central opening having an airfoil section and which acts as an aerodynamic lifting body utilizing spin imparted to it by a launching device to attain gyroscopic stability. The combination of lift, which at least partially counteracts the gravitational force acting upon the projectile, and aerodynamic stability results in a projectile having a flat trajectory and extended range capability. Heretofore, such projectiles have been employed in riot control to distribute a non-lethal payload, as, for example, a lacrimator such as tear gas, which is usually quite effective in dispelling a mob. The subsonic launch velocity attained by a light-weight projectile of the aforedescribed kind avoids personal injury or bodily harm due to impact, even at point-blank range. Examples of such projectiles are found in U.S. Pat. No. 3,980,023 to Misevich and U.S. Pat. Nos. 3,982,489 and 4,190,476 to Flatau et al.

At the opposite end of the spectrum the same type of ring airfoil projectile has been provided for use as a warhead to carry high explosive materials and other munitions for military use. An example of such a projectile is found in the Flatau, U.S. Pat. No. 3,877,383.

If the weight, size and resilience of such a projectile is carefully selected and a propellant charge is employed which will yield a desired muzzle velocity, it should be possible to produce a combination capable of inflicting an immediately debilitating if not lethal injury to a targeted individual attempting to commandeer an airliner and without serious risk of breaking a cabin window or otherwise rupturing the airliner fuselage. However, such ring airfoil projectiles as heretofore available are designed to be launched from a grenade launcher or the like adapted for attachment to the muzzle end of an existing firearm. Such weapons tend to be relatively large and cumbersome not well suited for concealment as would be necessary to deal with a skyjacker intent on highjacking a commercial aircraft. Accordingly, it is the general aim of the present invention to provide an improved self-contained round of ammunition having a ring airfoil projectile. It is a further aim of the present invention to provide a self-contained round having a ring airfoil projectile and which may be discharged from a simple compact holder or launcher which may be carried in a concealed location on an aircraft. Yet another aim of the invention is to provide a self contained round of ammunition having a projectile capable of producing a blunt trauma and inflicting an immediately debilitating injury to a targeted individual at close range within a commercial aircraft and without serious risk of breaking a cabin window of the aircraft or otherwise rupturing the fuselage. Still another aim of the invention is to provide a simple, compact launcher for such a round of ammunition.

SUMMARY OF THE INVENTION

In accordance with the present invention a self-contained round of ammunition having a ring airfoil projectile comprises a cartridge casing having a tubular body defined by a rifled bore and a base attached to a breech end of the cartridge body and providing a closure for the breech end. The ring airfoil projectile is carried by a sabot having an abutment surface thereon disposed within the bore and supported for limited movement from a loaded to a fired position within the bore. When the cartridge is fired the sabot is arrested at its fired position by an arresting surface defined by a radially, inward projection or annular cylindrical lip integrally formed on the tubular cartridge casing body which engages the abutment surface to prevent separation of the sabot from the cartridge casing.

BRIEF DESCRIPTION OF THE DRAWINGS

FIG. 5 is similar to FIG. 3 but shows the round and its projectile an instant after the round has been fired.

DETAILED DESCRIPTION OF PREFERRED EMBODIMENT

Figure 1:
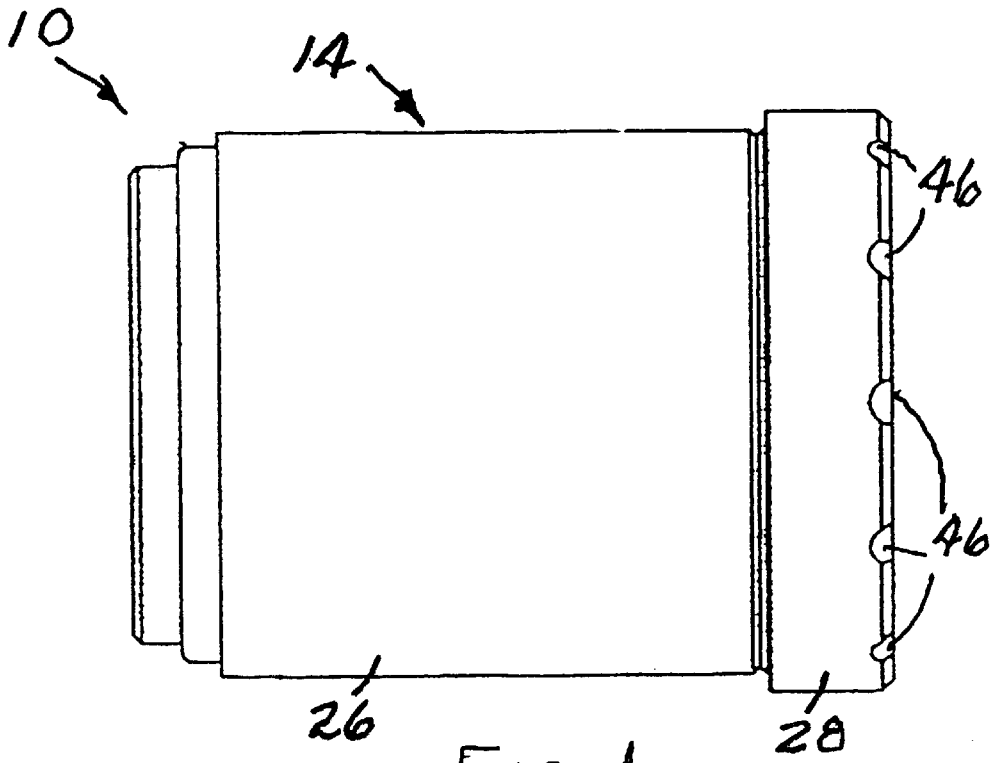
FIG. 1 is a side elevational view of a self-contained round of ammunition embodying the present invention.

Turning now to the drawings, a self-contained round of ammunition embodying the present invention and indicated generally by the reference numeral 10 contains a ring airfoil projectile 12 and all of the essential elements necessary to fire the projectile. More specifically, the illustrated round of ammunition 10 essentially comprises a rifled cartridge casing designated generally by the numeral 14, a sabot indicated generally at 16 which carries the projectile 12 and cooperates with the rifled casing to impart a spin to the projectile, and a power pod indicated generally at 18 which is mounted within the cartridge casing 14 and contains a primer 20, a wad 22 and a propellant charge 24, all of which will be hereinafter more fully described.

Considering now the round 10 in further detail, the cartridge casing 14 has an axially elongated generally cylindrical tubular body 26 and a base 28. The body 26 may be made from any suitable material, however, in accordance with present practice it is formed from a nylon compound, preferably ZYTEL ST 801 and has a forward or muzzle end and a rear or breech end. The cartridge body 26 has a rifled bore 30 characterized by lands and grooves which define the rifiling. The bore 30 opens through the breech end and is terminated proximate the muzzle end by a radially inwardly directed annular lip 32 which is integrally formed on the cartridge body and defines a coaxially smooth cylindrical bore opening 34 at the muzzle end which has a diameter somewhat smaller that the diameter of the bore 30. The lip 32 further defines a generally radially disposed annular arresting surface 36 facing axially inwardly and in the direction of the breech end of the casing body 26.

Figure 2:
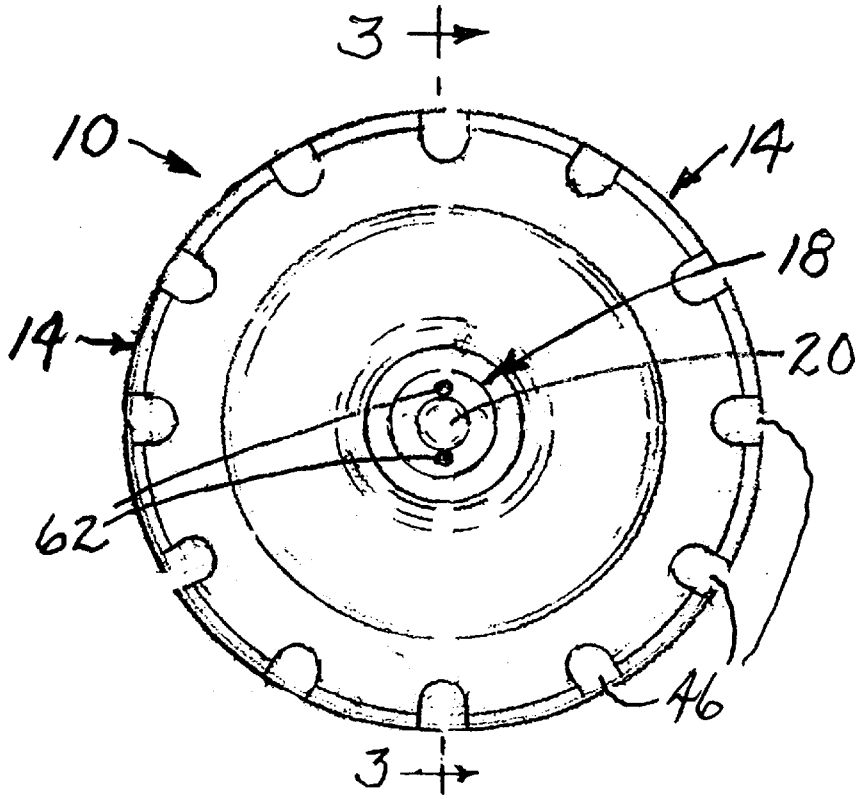
FIG. 2 is an end elevational view of the round of FIG. 1.

The presently preferred cartridge base 28 is made from LEXAN, comprises a generally cylindrical cup-shaped member internally threaded for mating connection with and external thread on the breech end of the casing body. The latter threaded connection, indicated at 38, is preferably provided by a modified butt thread for strength of connection. The base 28 defines a radially disposed rear wall 40 and has a generally cylindrical central stem 42 which projects coaxially into the bore 30. The rear wall 40 and stem 42 cooperate to define a coaxial generally cylindrical rearwardly and radially outwardly stepped charge bore 44 which extends coaxially through the cartridge base 28. The diametrically enlarged breech end portion of the charge bore 44 is internally threaded to receive the power pod 18, hereinafter further described. A forwardly facing radially disposed rim surface 45 on the cartridge base coaxially surrounds the casing body 26. A circumaxial series equiangularly spaced apart detent recesses or notches 46,46 are formed in the rear wall 40 and open radially outwardly and axially rearwardly as best shown in FIGS. 1 and 2, for a purpose which will be hereinafter further evident.

Figure 3:
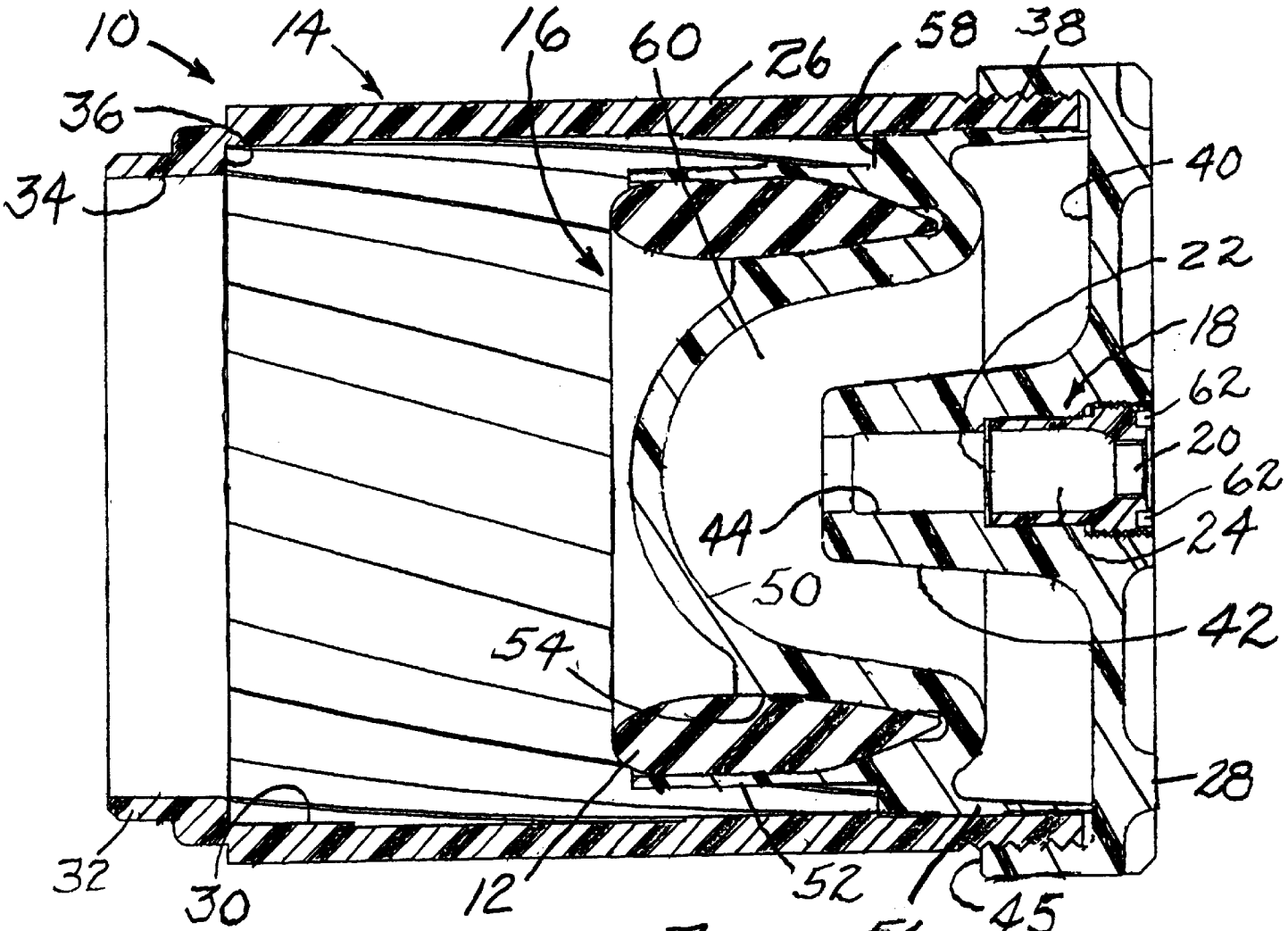
FIG. 3 is an axial sectional view taken along the line 3—3 of FIG. 2.
Figure 4:
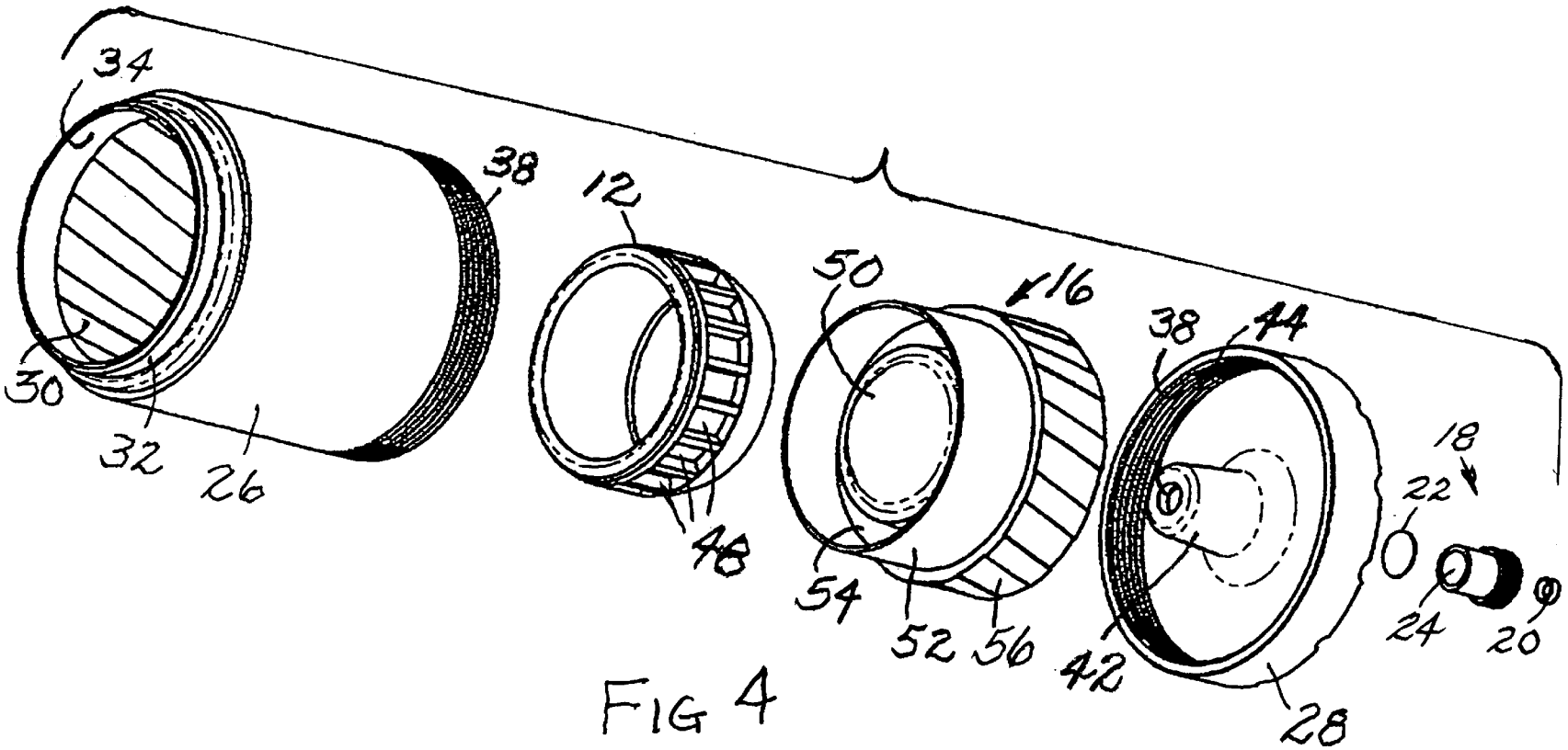
FIG. 4 is an exploded perspective view of the round.

The ring airfoil projectile 12 is preferably made from a rubber compound, comprises an annular ring shaped member defining a circular central opening and has a uniform airfoil-shaped cross section, as best shown in FIG. 3. A circumaxial series equiangularly spaced apart blind pockets 48,48 formed in the projectile 12 open radially outwardly and may contain oil of capsicum or a lacrimator such as tear gas crystals when the round 10 is to be used for riot or mob control. An annular band of frangible material (not shown) coaxially encircles the projectile 12 and forms a closure for the pockets 48,48. However, it should be understood that the projectile 12 may also be produced as a solid body, omitting the pockets, when the projectile is intended for use solely as an anti-personal missile to produce a blunt trauma.

As previously noted, the projectile 12 is carried by the sabot 16 which, like other parts of the structure, may be made from any suitable material. However, the presently preferred sabot 16 is formed from high density polyethylene and comprises a relatively thin walled shell coaxially symmetrical about a central axis. As best shown in FIG. 3 the sabot has a dome-shaped concavo-convex rearwardly open central portion 50 and a sleeve portion 52 integrally connected to the central portion and disposed in radially outwardly spaced coaxial surrounding relation to the central portion. The central portion 50 and the sleeve portion 52 cooperate to define a forwardly open annular pocket 54 for receiving and complementing a substantial portion of the outer surface and a lesser portion of the inner trailing surface of the ring airfoil projectile 12, substantially as shown in FIG. 3. The outside diameter of the cylindrical sleeve portion 52 is somewhat smaller that the diameter of the muzzle opening 34, so that it may pass freely through the muzzle opening when the round is fired. The sabot 16 further includes a coaxial cylindrical annular band 56 sized to match the bore 30 and characterized by lands and grooves which complement associated portions of the lands and grooves which define the bore rifling. A radially disposed and forwardly facing annular abutment surface 58 defined by the annular band 56 at its junction with the sleeve portion 52 is coaxially aligned with the arresting surface 36 at the muzzle end of the bore 30. In its loaded position, as it appears in FIG. 3, the rear edge of the annular band 56 is disposed generally adjacent and in engagement with the inner surface of the rear wall 40. Thus, the generally concave inner surface of the sabot 16 cooperates with the inner surface of the base 18 to define a pressure chamber 60. The ring airfoil projectile 12 is retained within the sabot 16 by tight frictional engagement with the wall of the recess defined by the sabot and within which it is contained. The sabot 16 is, in turn, retained in its loaded position within the cartridge casing 14 by tight engagement of the annular band 56 with the bore 30.

The propellant force for discharging or firing the round 10 is provided by the power pod 18 which comprises a generally cylindrical member having a coaxial rearwardly and radially inwardly stepped bore. The rear end portion of the cylindrical member 18 is threaded to be received within the threaded central opening in the base rear wall 28. The primer 20 carried by the power pod may, for example, comprise a No. 209 shotshell primer. As previously noted, the power pod also carries the propellant charge 24. The wad 22 is trapped within the stepped bore immediately forward of the propellant charge by assembly of the power pod with the base. A pair of diametrically opposed blind cylindrical openings 62,62 formed in the rear end of the power pod facilitate attachment of the pod to the cartridge base using a spanner wrench or the like.

Figure 6:
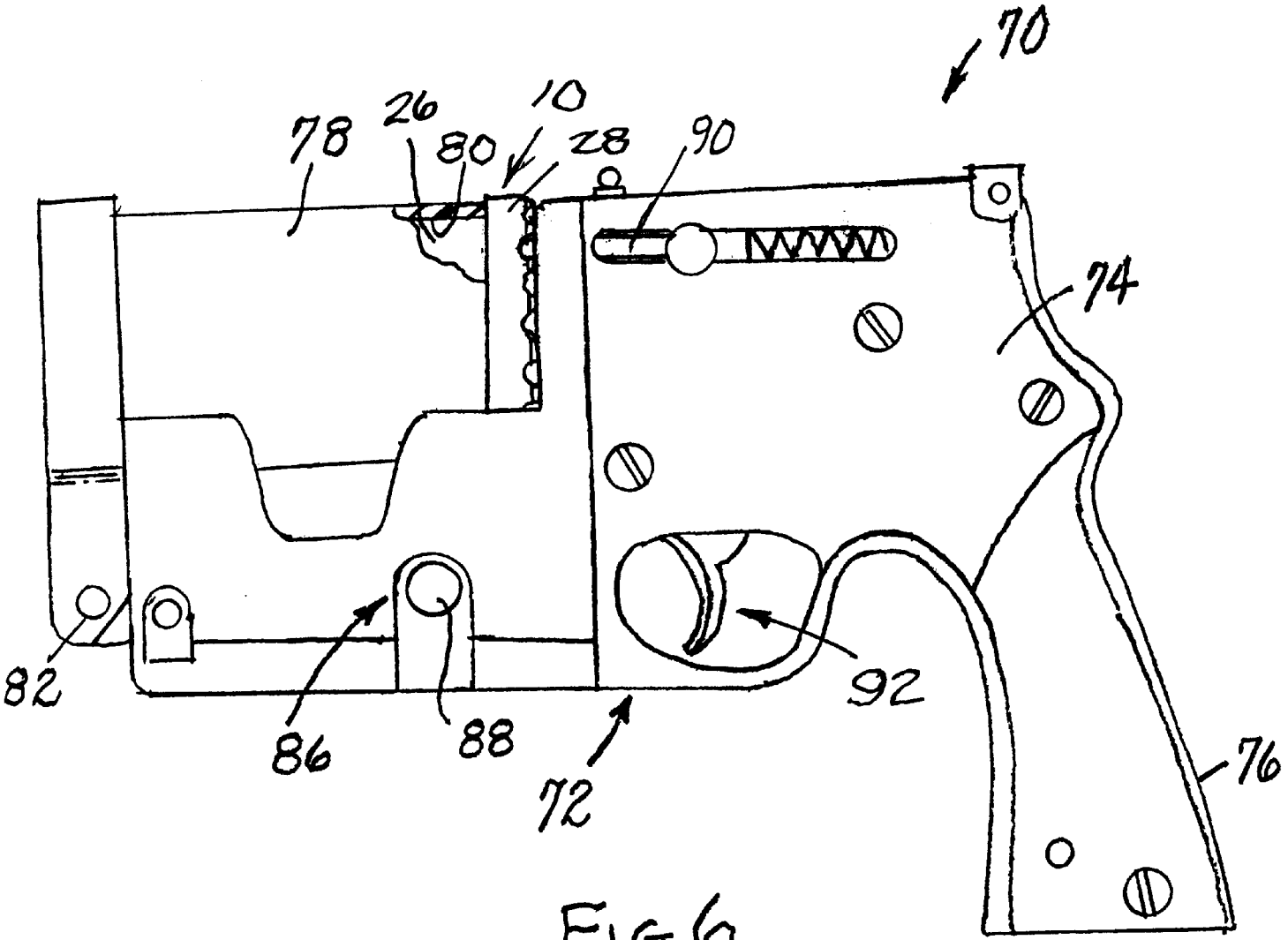
FIG. 6 is a side elevational view of a loaded launcher for firing the round shown in FIGS. 1–5.
Figure 7:
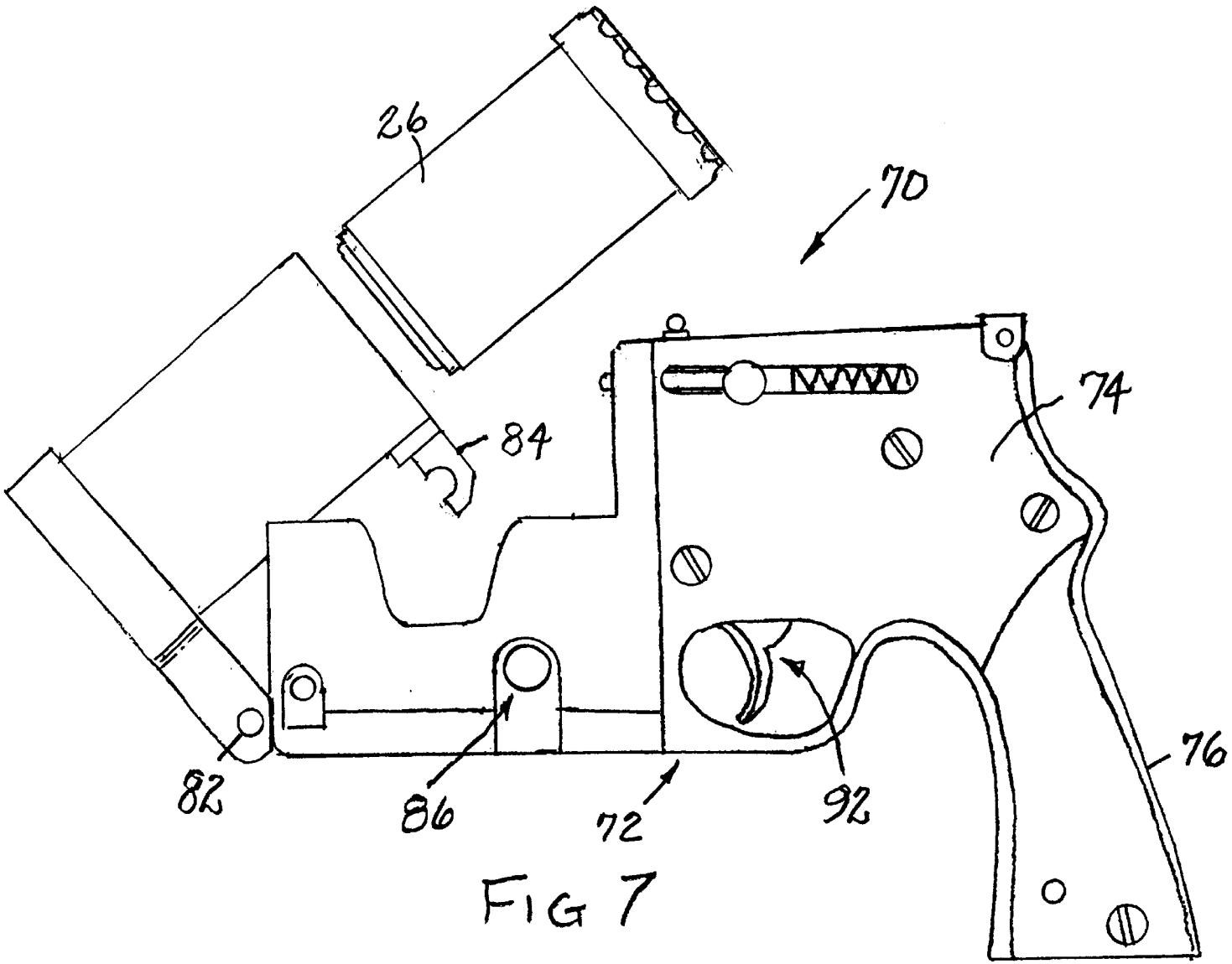
FIG. 7 is similar to FIG. 6 but shows the launcher in an open or round receiving position.

Since the round of the present invention is essentially a self-contained unit having its own barrel, rifling and means for controlling the trajectory of the projectile and imparting aerodynamic stability to it a launcher for firing the projectile may of simple construction and may take a wide variety of forms. An example of a simple pistol type launcher is shown in FIGS. 6 and 7 and indicated generally at 70 is hereinafter further described.

The launcher 70 has a frame indicated generally at 72 which includes a receiver 74 and a pistol grip 76. A tubular cartridge holder or barrel 78, which has a smooth cylindrical bore 80 sized to receive the cartridge body therein, is supported on the frame 72 for pivotal movement about a transverse axis by a pivot pin 82. The barrel 78 is movable between firing and cartridge receiving positions shown respectively in FIGS. 6 and 7. A barrel locking lug 84 carried by the barrel and shown in FIG. 7 cooperates with an ambidextrous barrel lock catch assembly indicated generally at 86 which includes a barrel releasing button 88 which extends transversely through and is operative from either side of the frame 72 to release the barrel from it firing position shown in FIG. 6 for movement to its loading position of FIG. 7. A biasing spring (not shown) normally biases the barrel toward its loading position of FIG. 7.

The rifled casing imparts spin to the sabot/projectile assembly when the round is fired and produces an opposite reactive force which acts upon the round and tends to spin the round about its axis and within the smooth barrel 78. This reactive force is overcome by the provision of a spring biased detent member 90 supported within the receiver 74 and urged toward and into engagement with the cartridge base 28 in its loaded position, as it appears in FIG. 6. The detent member 90 has a tip which projects forwardly from the receiver 74 to engage an associated detent notch 46 in the cartridge base, whereby the round 10 is positively restrained against angular movement about its axis and relative to the barrel 78 when the round is fired.

In the event that a round is loaded into the barrel 78 with the detent member 90 out of alignment with a detent notch 46 any initial movement of the cartridge about its axis upon firing will result in engagement of the detent member 90 within an associated notch 46 thereby preventing any further angular movement of the cartridge relative to the launcher 70. Thus, the rifling in the cartridge will be effective to impart aerodynamic stability to the projectile as it travels within the cartridge body 26 and toward the muzzle end thereof.

The launcher 70 further includes a trigger operated firing mechanism indicated generally at 92. The firing mechanism may be of any suitable type, consequently, only the trigger is shown. The presently preferred firing mechanism 92 comprises a double action mechanism wherein operation of the trigger pivots a hammer to and releases the hammer from a cocked position. The pivoted hammer is preferably connected by a linkage to a reciprocally movable firing pin coaxially aligned with the primer 20 when the round 10 is in its loaded position of FIG. 6. The spent round 10 is removed from the launcher 70 by operating the ambidextrous locking catch assembly 86 which allows the barrel 78 with the spent cartridge therein to be biased to its loading position of FIG. 7 whereupon the spent round may be dumped from the barrel to permit the launcher to be reloaded and locked in its loaded position.

I claim:

1. A self-contained round of ammunition comprising;

a cartridge casing having a tubular body including an axially elongated generally cylindrical rifled bore having a breech end and a muzzle end, said cartridge casing having a base forming a closure for said rifled bore at said breech end and defining a charge bore, a projectile assembly disposed within said rifled bore at said breech end and defining a bore engaging surface complementing an associated portion of said rifled bore, said projectile assembly including a sabot having an abutment surface thereon and a ring airfoil projectile carried by said sabot and cooperating with said base to define a pressure chamber in communication with said charge bore, a propellant charge contained within said charge bore, a primer carried by said cartridge casing for igniting said propellant charge, and an integral radial projection on said tubular body and extending into said rifled bore and defining an arresting surface facing in the direction of said breech end for engaging said abutment surface on said sabot and arresting said sabot generally within said cartridge casing to prevent separation of said sabot from said cartridge casing when said round is fired.

2. A self-contained round of ammunition as set forth in claim 1 wherein said sabot cooperates with said base to define said pressure chamber.

3. A self-contained round of ammunition as set forth in claim 1 wherein said sabot has an annular band therearound defining said bore engaging surface.

4. A self-contained round of ammunition as set forth in claim 1 wherein said lip defines a coaxial circular bore opening and said ring airfoil projectile has a major diameter smaller than said bore opening to pass freely through said bore opening when said round is fired.

5. A self-contained round of ammunition as set forth in claim 1 wherein said cartridge has a detent notch therein for cooperating with a detent member on an associated launcher to restrain said cartridge against angular movement about its axis and relative to the launcher.

6. A self-contained round of ammunition as set forth in claim 5 wherein said notch is formed in said base and opens radially and axially outwardly through said base.

7. A self-contained round of ammunition as set forth in claim 5 wherein said notch is formed in said base and opens radially outward through said base.

8. A self-contained round of ammunition as set forth in claim 5 wherein said notch is formed in said base and opens axially outwardly through said base.

9. A self-contained round of ammunition as set forth in claim 1 wherein said sabot has an annular band therearound defining said abutment surface.

10. A self-contained round of ammunition as set forth in claim 9 wherein said annular band defines said base engaging surface.

11. Self-contained cartridge/launcher for ring airfoil projectile comprising;

a tubular casing having a cylindrical rifled bore including a muzzle end and a breech end, said casing having a radially inwardly directed integral lip at said muzzle end defining a coaxial circular opening having a diameter smaller than the diameter of said rifled bore and defining a coaxial annular abutment surface within said bore and facing in an axial direction toward said breech end, a cartridge base connected to said casing at said breech end and forming a closure for said breech end having a coaxial central portion extending coaxially into said rifled bore and defining a coaxial charge bore having at least one opening at an inner end portion thereof, a propellant charge contained within said charge bore, a primer coaxially mounted on said cartridge base and within said bore, a sabot disposed in a loaded position within said rifled bore and having a trailing end portion engaging said cartridge base and including lands and grooves complementing an associated portion of said rifled bore, said sabot having an inner surface defining a substantially coaxially symmetrical recess opening toward said cartridge base, said inner surface cooperating with said cartridge base in said loaded position to define a pressure chamber, said sabot having a coaxial annular carrying recess opening in the direction of said muzzle end and a coaxial annular abutment surface disposed radially outward of said carrying recess and in opposing axially spaced relation to said annular arresting surface for engaging said arresting surface to retain said sabot within said casing when the cartridge is fired, and a ring airfoil projectile having an annular trailing portion disposed within and generally complementing said carrying recess, said ring airfoil projectile having a major diameter smaller than the diameter of said circular opening.

12. A self-contained round of ammunition comprising:

a cartridge casing having a tubular body including an axially elongated generally cylindrical rifled bore having a breech end and a muzzle end, said cartridge casing having a base forming a closure for said bore at said breech end defining a charge bore, a projectile assembly disposed within said rifled bore at said breech end and defining a bore engaging surface complementing an associated portion of said rifled bore, said projectile assembly including a sabot cooperating with said base to define a pressure chamber for communication with said charge bore and a ring-airfoil projectile carried by said sabot a propellant charge contained within said charge bore, a primer carried by said cartridge casing for igniting said propellant charge, and an integral radially inwardly directed annular arresting lip on said tubular body at said muzzle end of said rifled bore defining a radially disposed annular arresting surface facing in the direction of said breech end for arresting said sabot and retaining it generally within said cartridge casing when said round is fired.

13. A self-contained round of ammunition as set forth in claim 12 wherein said sabot has an annular band therearound defining an abutment surface for engaging said arresting surface when said round is fired.

14. A self-contained round of ammunition as set forth in claim 13 wherein said annular band defines said base engaging surface.

* * * * *